US006443397B1

(12) United States Patent
Morris

(10) Patent No.: US 6,443,397 B1
(45) Date of Patent: Sep. 3, 2002

(54) TETHER FOR HOLDING PROMOTIONAL MATERIALS

(76) Inventor: Todd Christian Morris, 7507-A Endotrail, Greensboro, NC (US) 27409

( * ) Notice: Subject to any disclaimer, the term of this patent is extended or adjusted under 35 U.S.C. 154(b) by 0 days.

(21) Appl. No.: 09/460,669

(22) Filed: Dec. 14, 1999

(51) Int. Cl.[7] ..... A63H 27/08

(52) U.S. Cl. ..... 244/153 R; 280/727; 446/34; 446/176; 446/179

(58) Field of Search ..... 244/153 R, 154; 446/34, 176, 178, 179; 280/727

(56) References Cited

U.S. PATENT DOCUMENTS

| | | | | | |
|---|---|---|---|---|---|
| 2,227,918 | A | * | 1/1941 | Trombla | 446/34 |
| 2,919,577 | A | * | 1/1960 | Cone | 446/176 |
| 4,133,500 | A | | 1/1979 | Chapman | 244/153 |
| 4,190,218 | A | | 2/1980 | Cousens, Jr. | 244/155 |
| 4,760,979 | A | | 8/1988 | Mileti | 244/153 |
| 4,798,356 | A | | 1/1989 | Alonso | 244/153 |
| 4,871,133 | A | | 10/1989 | Alonso | 244/153 |
| 5,127,611 | A | | 7/1992 | Payne et al. | 244/153 |
| 5,131,609 | A | | 7/1992 | Prouty | 244/155 |
| 5,186,675 | A | * | 2/1993 | Stoddard | 446/199 |
| 5,524,851 | A | * | 6/1996 | Huang | 244/153 R |
| 6,283,816 | B1 | * | 9/2001 | Pascual | 244/153 R |

* cited by examiner

*Primary Examiner*—J. Woodrow Eldred
(74) *Attorney, Agent, or Firm*—MacCord Mason PLLC

(57) ABSTRACT

A miniature car kite. The device includes an aero-resistant shape, such a disc, airplane, kite or figure; and a semi-rigid tether attached to the shape. In the preferred embodiment, the tether includes a pre-determined length of a semi-rigid material and a mounting platform at one end for mounting the miniature car kite to the tether. A clip for attaching the miniature car kite to the grill of an air vent is attached to the distal end of the tether.

13 Claims, 4 Drawing Sheets

TETHER FOR HOLDING PROMOTIONAL MATERIALS

BACKGROUND OF THE INVENTION (1) Field of the Invention

The present invention relates generally to kites and, more particularly, to a miniature kite or promotional display, which is adapted to be attached to the heating and air conditioning vent of an automobile or to the grill of a cooling fan.

(2) Description of the Prior Art

All parents know how trying a long car trip with a young child can be. A young child's attention span is very short and after an hour of so in a car, a child is apt to complain loudly. Also, today many families live far from their hometowns and such long trips are not easily avoided. Children, however, do enjoy movement and many parents have attached mobiles in a child's room next to their crib or bed.

Unfortunately, the interior of a car does not allow many places where such traditional eye-catching devices can be attached. In addition, the driver's view of the road both in front of him and behind him must not be obscured.

U.S. Pat. No. 5,127,611 issued Jul. 7, 1992 to Payne et al. teaches the construction of a miniature kite of only about 4 by 6 inches. U.S. Pat. No. 4,190,218, issued Feb. 26, 1980 to Cousens et al. teaches a miniature kite which is adapted to be tethered to the back of a bicycle by an elastic cord. Both of these patents are hereby incorporated by reference in their entirety. Neither of these patents teach any way in which to fly a kite inside the car. As can be readily appreciated, flying such kites outside to a moving car could put a young child in great danger.

Thus, there remains a need for a new and improved miniature kite which can be safely flown in a automobile while, at the same time, can be easily attached to a source of moving air in the automobile, such as a heating and air conditioning vent.

SUMMARY OF THE INVENTION

The present invention is directed to a miniature car kite or promotional display. The device includes an aero-resistant shape and a semi-rigid tether attached to the shape. As used herein, "kite: is intended in its broadest possible meaning, such a disc, airplane, conventional box or 4 sided kite or figure. In the preferred embodiment, the tether includes a pre-determined length of a semi-rigid material and a mounting platform at one end for mounting the miniature car kite to the tether. A mounting means for attaching the miniature car kite to the vent of an automobile is attached to the distal end of the tether.

The aero-resistant shape further includes an aerodynamic surface to help stabilize the kite in the air stream. In the preferred embodiment, the aerodynamic surface is formed by a V-shaped, vertical fold.

The mounting platform may be disc-shaped and also includes a V-shaped, vertical fold co-aligned with the aerodynamic surface of the aero-resistant shape. A fastening means, such as a mechanical fastener, adhesive or friction clip attached the mounting platform to the aero-resistant shape.

In the preferred embodiment, the pre-determined length of semi-rigid material is a resilient metal or plastic. The length to diameter ratio of the semi-rigid material so high that the tether is just self-supporting. In the preferred embodiment, the tether further includes a tapered base which provides additional support near the mounting means while, at the same time, allows the distal end of the tether to be as string-like as possible. This permits the aero-resistant shape to fly more lifelike.

In the preferred embodiment, the mounting means is a U-shaped clip attached to the distal end of the tether. The U-shaped clip may further includes at least one outwardly flared prong for helping attach the clip to the automobile vent. The U-shaped clip may be integrally formed with the tether.

Accordingly, one aspect of the present invention is to provide a miniature car kite. The device includes an aero-resistant shape; and a semi-rigid tether attached to the shape.

Another aspect of the present invention is to provide a tether for a miniature car kite. The device includes a pre-determined length of a semi-rigid material; and a mounting platform at one end for mounting the miniature car kite to the tether.

Still another aspect of the present invention is to provide a miniature car kite. The device includes an aero-resistant shape; and a semi-rigid tether attached to the shape, the tether including (i) a pre-determined length of a semi-rigid material; and (ii) a mounting platform at one end for mounting the miniature car kite to the tether; and a mounting means for attaching the miniature car kite to the vent of an automobile.

These and other aspects of the present invention will become apparent to those skilled in the art after a reading of the following description of the preferred embodiment when considered with the drawings.

DESCRIPTION OF THE PREFERRED EMBODIMENTS

Figure 1:
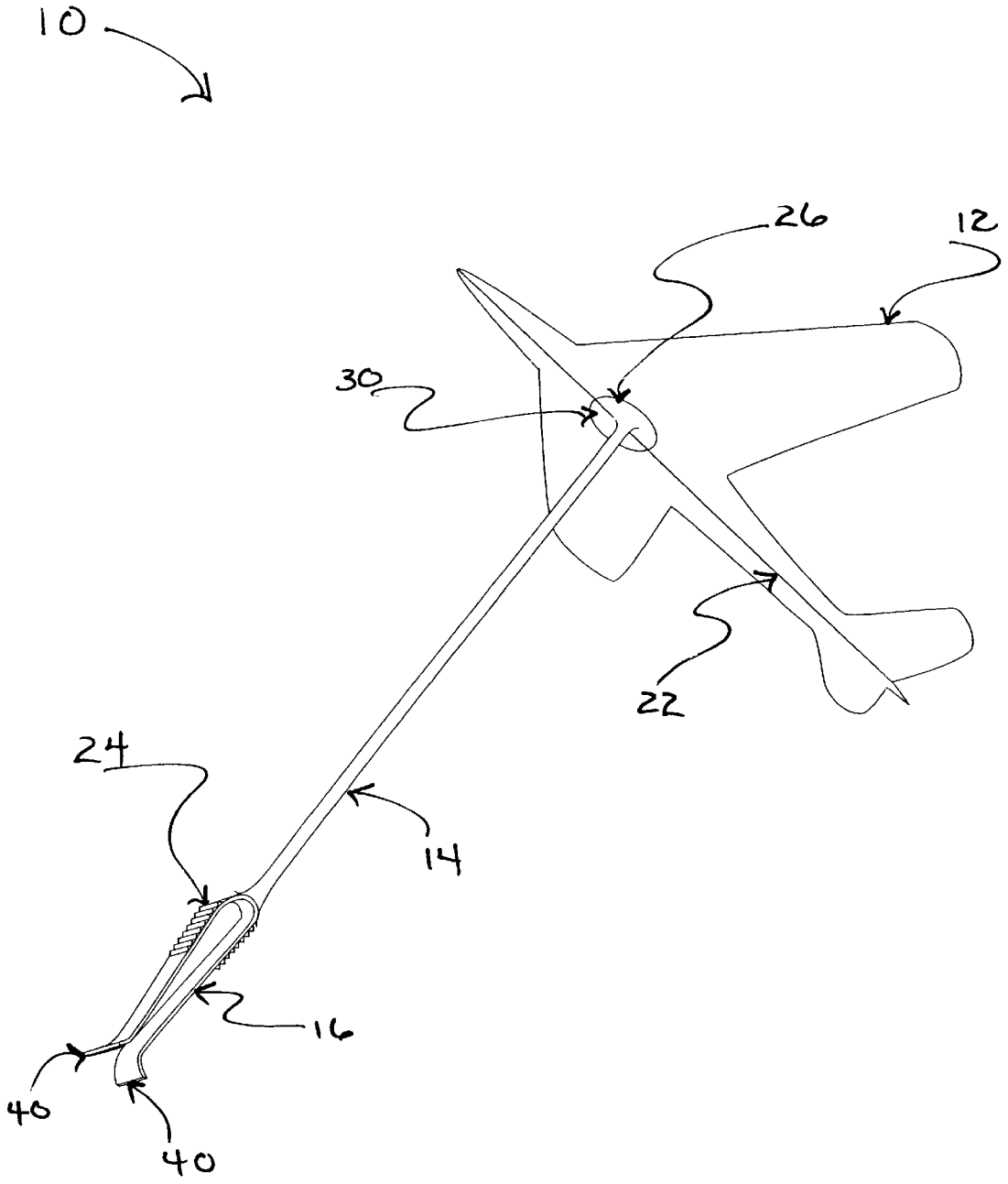
FIG. 1 is a perspective view of a miniature car kite constructed according to the present invention.
Figure 2:
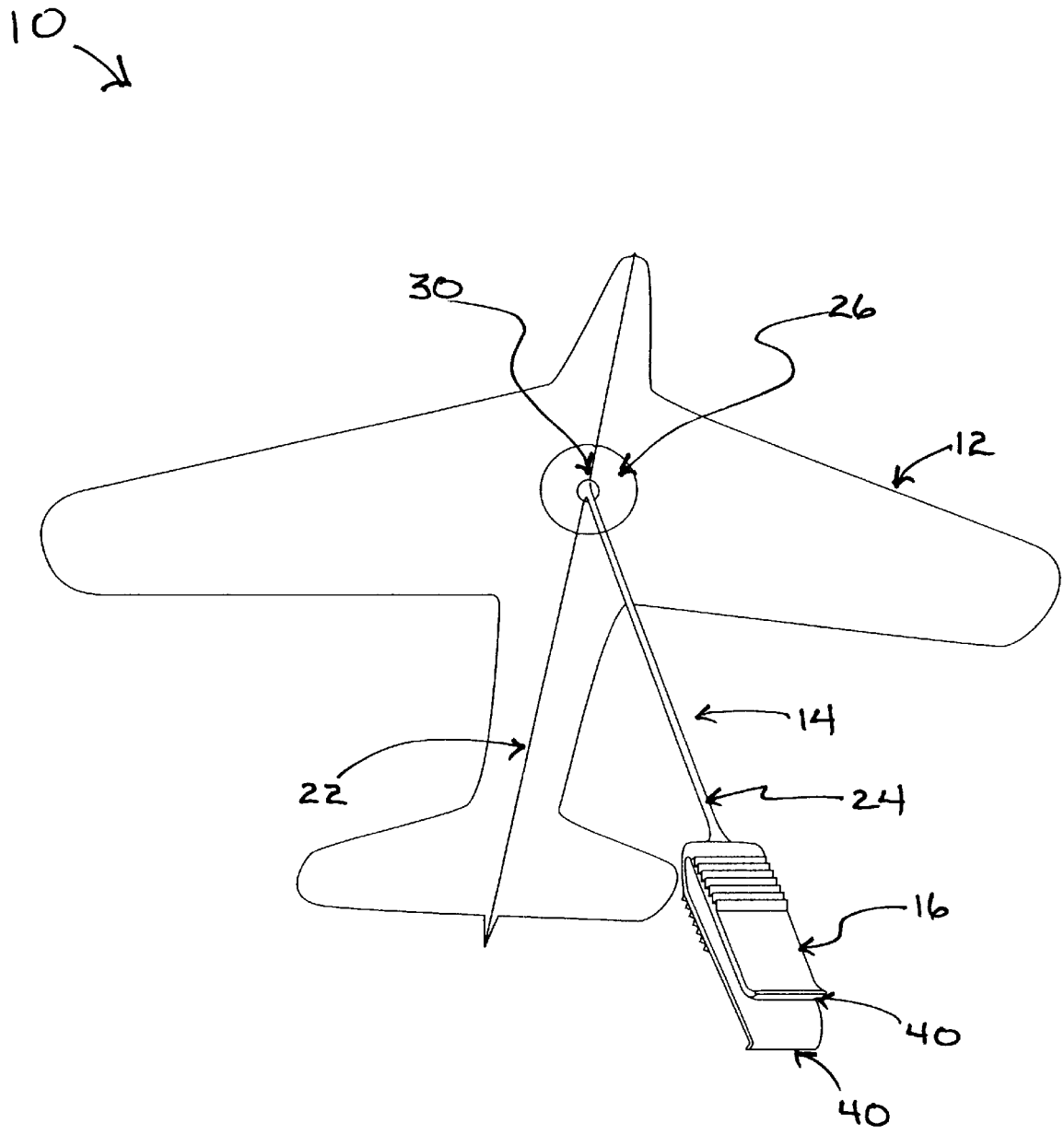
FIG. 2 is an enlarged front perspective view of the miniature car kite shown in FIG. 1.
Figure 3:
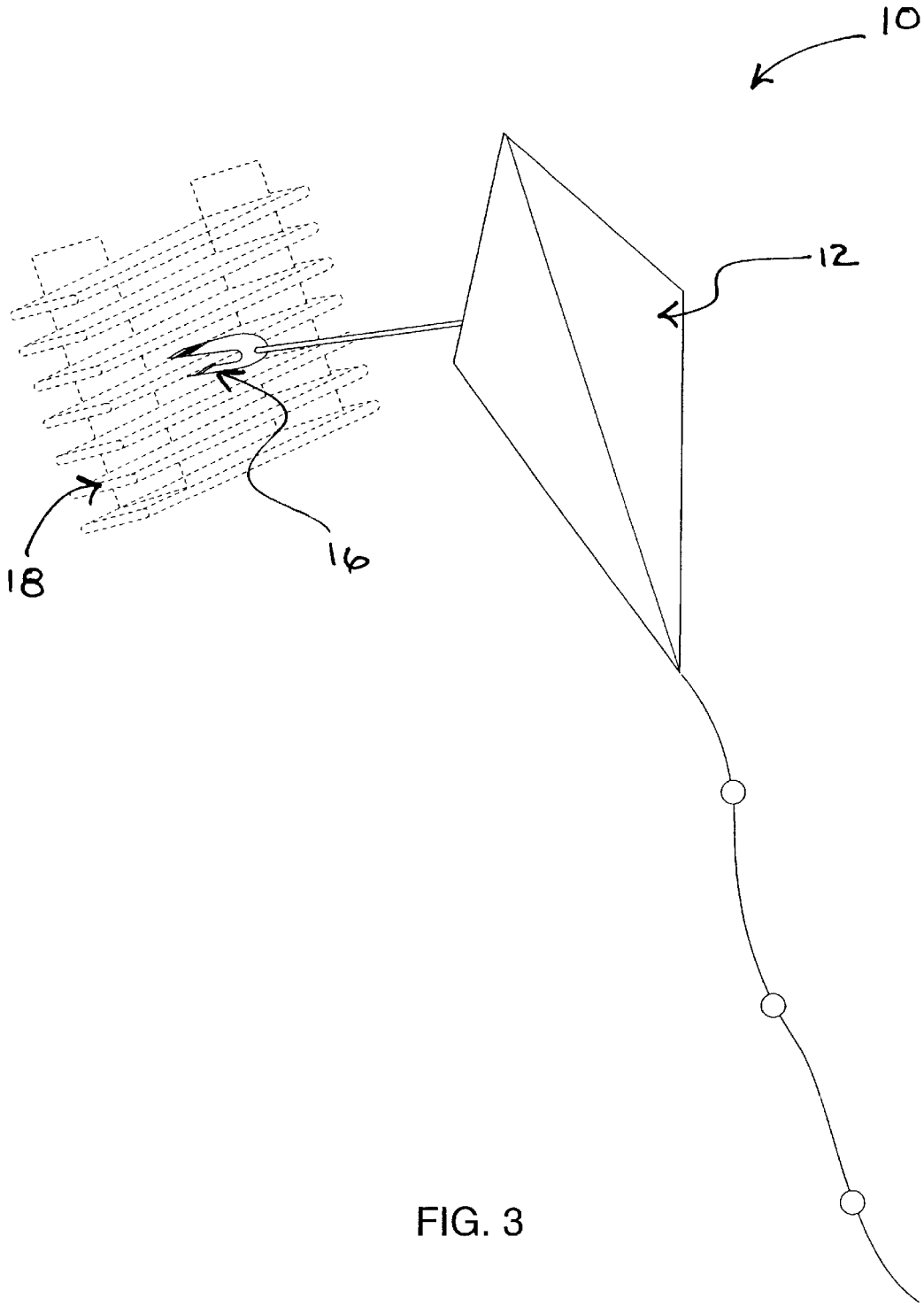
FIG. 3 is a rear perspective view of an alternative embodiment of the miniature car kite of the present invention showing its attachment to the vent of an automobile.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a miniature car kite, generally designated 10, is shown constructed according to the present invention. The miniature car kite 10 includes three major sub-assemblies: an aero-resistant shape 12; a semi-rigid tether 14; and a mounting means 16 for attaching the miniature car kite 10 to the vent 18 of an automobile.

The aero-resistant shape 12 may further includes an aerodynamic surface 20 which provides better stability in flight of the aero-resistant shape. In the preferred embodiment, the aerodynamic surface 20 may be created by forming a V-shaped fold along the length of the aero-resistant shape 12. In preferred embodiment, the V-shaped fold is a vertical fold 22. The vertical fold has been found to help in preventing undesirable side to side movement of the kite during flying.

Also in the preferred embodiment, semi-rigid tether 14 may further includes a tapered base 24. A tapered base provides strength adjacent to the mounting means 16 while, at the same time, provides sufficient flexibility along the length of the tether 14 to enable the miniature car kite to fly easily.

In the preferred embodiment, semi-rigid tether 14 is formed of a resilient material, such as a metal or plastic. The length of the tether 14 and the elastic modulus of the chosen material determine the diameter of the tether 14. In the preferred embodiment, for a nylon thermoplastic material, a diameter of about 0.020 inches is sufficient such that the semi-rigid tether 14 is just self-supporting before the aero-resistant shape 12 is attached. As can be readily appreciated, the weight of the aero-resistant shape 12 cannot be so great that the flow of air from may further 18 will not cause the aero-resistant shape 12 to fly. For a given aero-resistant shape, this point can be determined without undue experimentation.

It is expected, that for an aero-resistant shape 12 having a weight of only about 1 gram or less, substantially the same semi-rigid tether 14 could be used without modification. However, for very light or very heavy, relatively speaking, aero-resistant shapes, it may be necessary to increase or decrease the diameter of the shaft forming the semi-rigid tether 14.

Figure 4:
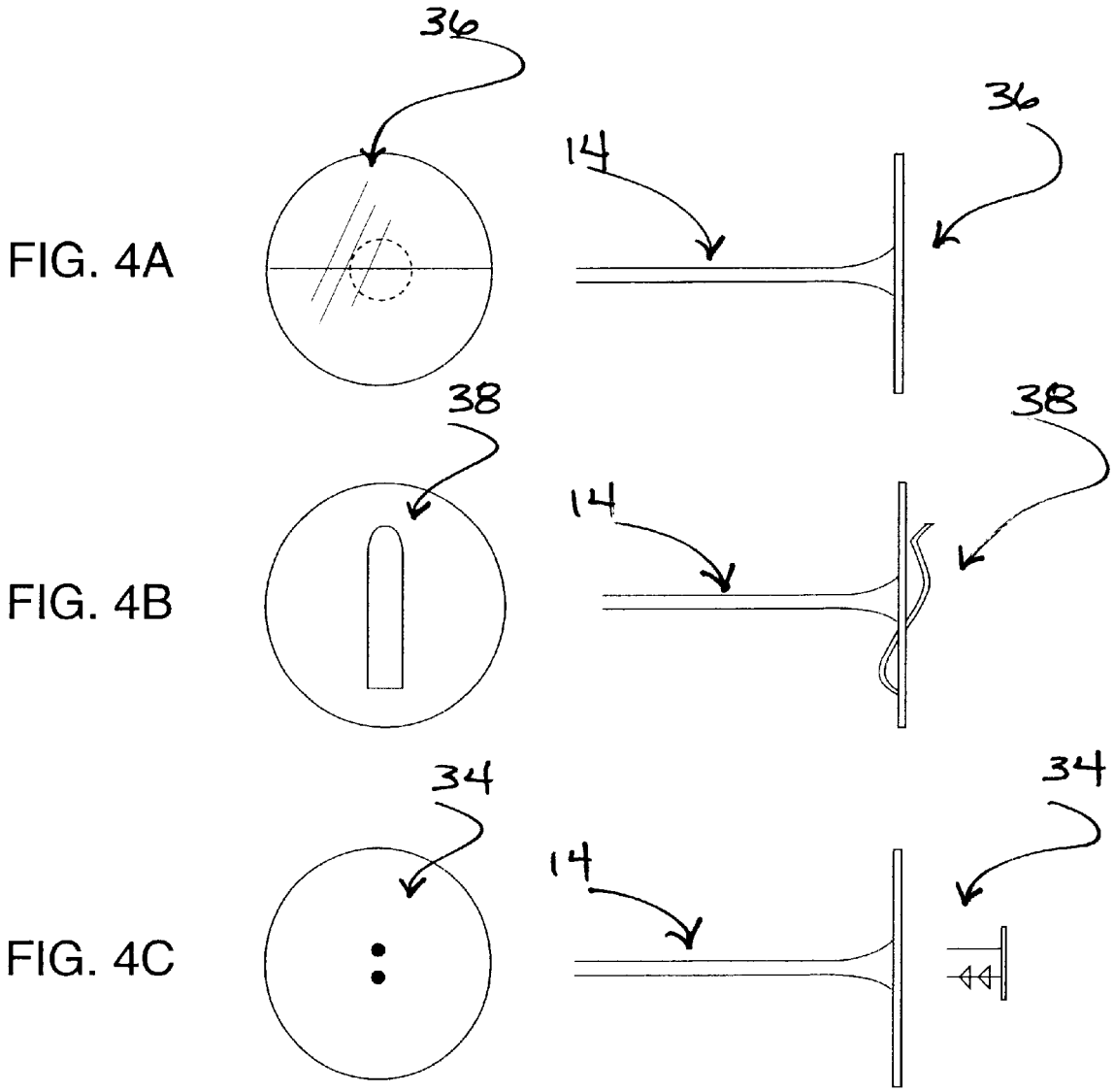
FIGS. 4A–4C are side views of alternative embodiments for attaching the aero-resistant shape to the semi-rigid tether to form the miniature car kite of the present invention.

In the preferred embodiment, a mounting platform 26 is attached to be distal end of the semi-rigid tether 14 for receiving the aero-resistant shape 12. Mounting platform 26 may be disc-shaped and include a V-shaped vertical fold 30 aligned with vertical fold 22 of the aero-resistant shape 12. Mounting platform 26 may further include a fastening means for attaching the aero-resistant shape 12 to mounting platform 26. As best seen in FIGS. 4A–4C, the fastening means may be a mechanical fastener 34, an adhesive 36 or a friction clip 38.

Mounting means 16 on the distal end of the semi-rigid tether 14 is preferably a U-shaped clip having a pair of outwardly flared prongs which permits the U-shaped clip to be more easily attached to the vent 18 of the automobile. In the preferred embodiment, the U-shaped clip is integrally formed with semi-rigid tether 14 by a conventional, plastic injection process.

In operation, the miniature car kite 10 may be sold as a kit including the aero-resistant shape 12; semi-rigid tether 14; and mounting means 16 for attaching the miniature car kite 10 to the vent 18 of an automobile. When sold as a paper kit, the aerodynamic surface 20 may be created by forming a V-shaped fold along the length of the aero-resistant shape 12. The a mounting platform 26 attached to be distal end of the semi-rigid tether 14 is attached to the aero-resistant shape 12 by a mechanical fastener 34, an adhesive 36 or a friction clip 38. The mounting means 16 on the distal end of the semi-rigid tether 14, preferably a U-shaped clip having a pair of outwardly flared prongs, is then to the vent 18 of the automobile. A very young child will be entertained by the movement of the kite due to the flow of air from the vent. An older child may color or paste stickers on the kite before it is attached to the vent.

In addition, an adult could display a favorite promotional item such as a cut-out of a racing car, or college logo or greeting card, etc.

Certain modifications and improvements will occur to those skilled in the art upon a reading of the foregoing description. By way of example, the promotional display could be an abstract object. Also, the tether could use the friction clip to allow the distal end to be connected to the top of a greeting card. It should be understood that all such modifications and improvements have been deleted herein for the sake of conciseness and readability but are properly within the scope of the following claims.

I claim:

1. A tether for holding promotional materials attachable to a car air vent, said device comprising:

(a) a pre-determined length of a semi-rigid material;

(b) a mounting platform at one end for mounting said promotional materials to said tether; and (c) mounting means for attaching said tether to the grill of said car air vent.

2. The device according to claim 1, wherein said mounting platform is disc-shaped.

3. The device according to claim 1, wherein said mounting platform further includes a fastening means.

4. The device according to claim 3, wherein said fastening means is a mechanical fastener.

5. The device according to claim 3, wherein said fastening means is an adhesive.

6. The device according to claim 3, wherein said fastening means is a friction clip.

7. The device according to claim 1, wherein said pre-determined length of semi-rigid material is resilient.

8. The device according to claim 7, wherein said semi-rigid material is a metal.

9. The device according to claim 7, wherein said semi-rigid material is a plastic.

10. The device according to claim 1, wherein said pre-determined length of semi-rigid material further includes a tapered base.

11. The device according to claim 1, wherein said mounting means is U-shaped clip attached to the distal end of said tether.

12. The device according to claim 11, wherein said U-shaped clip further includes as least one outwardly flared prong.

13. The device according to claim 11, wherein said U-shaped clip is integrally formed with said tether.

* * * * *